US007454865B2

(12) United States Patent
Kerscher

(10) Patent No.: US 7,454,865 B2
(45) **Date of Patent: *Nov. 25, 2008**

(54) DOOR JAMB COMPONENTS, AND DOOR JAMB COMBINATIONS, SUBASSEMBLIES, AND ASSEMBLIES

(75) Inventor: Lawrence Frank Kerscher, De Pere, WI (US)

(73) Assignee: Bay Industries, Inc., Green Bay, WI (US)

( * ) Notice: Subject to any disclaimer, the term of this patent is extended or adjusted under 35 U.S.C. 154(b) by 403 days.

This patent is subject to a terminal disclaimer.

(21) Appl. No.: 11/005,725

(22) Filed: Dec. 7, 2004

(65) Prior Publication Data

US 2005/0097838 A1 May 12, 2005

Related U.S. Application Data

(63) Continuation of application No. 10/109,759, filed on Mar. 28, 2002, now Pat. No. 7,111,433.

(60) Provisional application No. 60/355,592, filed on Feb. 7, 2002.

(51) Int. Cl.
*E06B 1/04* (2006.01)

(52) U.S. Cl. ..... 52/204.1; 52/211

(58) Field of Classification Search ..... 52/211, 52/212, 213, 656.4, 204.1; D25/119, 124, D25/125

See application file for complete search history.

(56) References Cited

U.S. PATENT DOCUMENTS 2,755,895 A 7/1956 Walterman et al.
3,103,263 A 9/1963 Leeser
3,591,985 A 7/1971 Coppins
3,609,928 A 10/1971 Mock
3,774,345 A 11/1973 Cole et al.
3,783,559 A 1/1974 Yocum et al.
4,236,354 A 12/1980 Passovoy
4,281,480 A 8/1981 Wendt (Continued)

OTHER PUBLICATIONS

Kolbe and Kolbe Millwork Co., Nov. 5, 2003 Product Bulletin No. 34.

(Continued)

*Primary Examiner*—Richard E Chilcot, Jr.
*Assistant Examiner*—Jessica Laux
(74) *Attorney, Agent, or Firm*—Thomas D. Wilhelm; Wilhelm Law Service

(57) ABSTRACT

Metal cladding as jamb cover assemblies and mullion cover assemblies, for door frames and mullions, using extrusions as cladding over substrates. A jamb cover assembly includes a jamb plate, a nosing, and a nailing fin. The nailing fin extends from a distal side of the assembly. Accordingly, the frame can be secured in a rough opening of a building with the nosing assembled to the jamb plate, and using the nailing fin for the securement, without any assembly or disassembly of the frame at the construction site. Regarding the mullion cover assembly, first and second jamb plates are on opposing sides of a mullion substrate. A mullion nosing is assembled to the jamb plates, and bridges the jamb plates to join together the two jamb plates and the nosing, to provide complete overlayment of the outer surface of the mullion substrate and to space the front panel of the nosing from the outer surface of the substrate.

37 Claims, 3 Drawing Sheets

U.S. PATENT DOCUMENTS

| | | | | | |
|---|---|---|---|---|---|
| 4,308,692 | A | | 1/1982 | Rumble et al. | |
| 4,505,080 | A | | 3/1985 | Sailor | |
| 4,509,294 | A | | 4/1985 | Boilard | |
| 4,531,337 | A | | 7/1985 | Holdiman | |
| 4,578,905 | A | | 4/1986 | Hout | |
| 4,821,472 | A | * | 4/1989 | Tix | 52/204.55 |
| 4,958,469 | A | | 9/1990 | Plummer | |
| 4,999,957 | A | * | 3/1991 | Kessler | 52/213 |
| 5,058,323 | A | | 10/1991 | Gerritsen | |
| 5,070,651 | A | * | 12/1991 | Jeter | 49/505 |
| 5,072,547 | A | | 12/1991 | DiFazio | |
| 5,119,609 | A | | 6/1992 | Tait et al. | |
| 5,375,383 | A | | 12/1994 | Lin et al. | |
| 5,437,130 | A | | 8/1995 | Raynak | |
| 5,572,840 | A | | 11/1996 | Fast et al. | |
| 5,590,496 | A | | 1/1997 | Martin et al. | |
| 5,619,823 | A | | 4/1997 | Ruff et al. | |
| 5,619,828 | A | | 4/1997 | Ver Meer | |
| 5,722,207 | A | | 3/1998 | Anderson et al. | |
| 5,758,458 | A | * | 6/1998 | Ridge | 52/204.1 |
| 6,125,605 | A | | 10/2000 | Young | |
| 6,223,484 | B1 | | 5/2001 | Minter | |
| 6,293,061 | B1 | | 9/2001 | Horak, Jr. | |
| 6,343,438 | B1 | | 2/2002 | Boldt | |
| 6,405,506 | B2 | | 6/2002 | Ruff | |
| 6,568,137 | B2 | * | 5/2003 | Ballantyne | 52/211 |
| 6,857,232 | B2 | * | 2/2005 | Bealko | 52/211 |
| 7,111,433 | B2 | * | 9/2006 | Kerscher | 52/212 |
| 2007/0074469 | A1 | | 4/2007 | Plagemann et al. | |

OTHER PUBLICATIONS

Photocopy of a cross section of a door jamb assembly which is believed to be publicly known. Such door jamb may have been manufactured by the Wausau Supply Company of Wausau, Wisconsin. Earliest date on information and is 1995-1996.

Photocopy of cross section of FLB27, (developed Nov. 1999) with FLB-34 nosing (developed Nov. 1999) mounted thereto.

Photocopy of cross section of FLB29 (developed Dec. 1997) with three locking points.

Photocopy of cross section of FLB29 (developed Nov. 1999) with two locking points.

Photocopy of cross section of FLB293 (developed Jun. 2000) with two locking points.

Wausau Supply Profile Sheet, showing nail fin as of 1995-1996: (developed 1995).

Frontline Clad System (developed 1995).

Outswing Jamb Cover (developed Aug. 2002).

Entry Door Clad System, Casco, Mar. 2001, 5 sheets.

Custom Aluminum Products, Inc., date unknown, 5 sheets.

Photocopy of a cross-section of a door jamb assembly which is believed to be publicly known.Such door jamb may have been manufactured by the Wausau Supply Company of Wausau, WI.

Author unknown. Title unknown. Photocopy of what appears to be a catalog page from Wausau Supply Company received from Dusty Dvorak. Publication information unknown.

Frontline BLDG. Products, Clad Overhead Door Frames, Brochure, Copyrighted 1996, 2 Pages.

Frontline BLDG. Products, Clad Entry Door Systems, Brochure, Copyrighted 1996, 2 Pages.

Equalizer Products, Clad Frame Systems, The Inside Advantage Over Outside Maintenance, Dated Oct. 1997, 3 Pages.

Frontline BLDG. Products, Aluminum Clad Gargage Door Frame Copyrighted 1998, 2 Pages.

Frontline BLDG. Products, New For 1998 . . . Frontline "Classic Clad System", Undated, 1 Page.

Frontline BLDG. Products, Classic Clad System, Copyrighted 1999, 2 Pages.

Frontline BLDG. Products, Cladding Solutions For Every Situation, Undated, 2 Pages.

Frontline BLDG. Products, Frontline "Classic Clad System", Copyrighted 1999, 2 Pages.

Frontline BLDG. Products, Classis Clad System, Undated, 2 Pages.

Frontline BLDG. Products, Aluminum Clad Garage Door Frame, Copyrighted 2000, 2 Pages.

Frontline BLDG. Products, Aluminum Clad Classic Garage Door Frame, Copyrighted 2000, 2 Pages.

Frontline BLDG. Products, Entry Door Cladding Classic System, Copyrighted 2000, 2 Pages.

Frontline BLDG. Products, Frontline "Classic Clad System", Undated, 2 Pages.

Frontline BLDG. Products, New Frontline Cladding System, Undated, 1 Page.

Wausau Supply Company, Clad System Components, Facsimile Dated 2005, 1 Page.

* cited by examiner

DOOR JAMB COMPONENTS, AND DOOR JAMB COMBINATIONS, SUBASSEMBLIES, AND ASSEMBLIES

This application is a Continuation of application Ser. No. 10/109,759, filed Mar. 28, 2002, which is herein incorporated by reference in its entirety. Application Ser. No. 10/109,759 is the non-provisional of application Ser. No. 60/355,592. Accordingly, this application claims priority under 35 U.S.C. 120 to application Ser. No. 10/109,759 and to application Ser. No. 60/355,592.

BACKGROUND

This invention pertains specifically to prefabricated and otherwise cladded metal door frames and mullions, using extrusions as cladding over frame substrate elements.

When installing a door frame into a door opening in a building, it is desirable to have a strong, durable frame which is either prefabricated or easily assembled on the construction site. Preferably, the frame can be assembled at an off-site manufacturing location. In the alternative, it is desirable to have frame elements which are easily assembled at the construction site.

In a typical construction project involving doors, door frames or mullions are fabricated by a frame or mullion fabricator, and shipped to a door assembler. The door assembler receives the frames and/or mullions as fabricated, and assembles e.g. the frames to respective door slabs. The slabs are also commonly purchased separately, from slab manufacturers. The door assembler adds the desired glass inset, if any, to the door slab, assembles the door slab to a selected door frame, and ships the thus assembled door, including frame and slab, to the construction site for installation on the building.

Typically, the basic frame is wood. The door assembler can easily up-grade the quality and value of the frame, and thus the quality and value of the door assembly, by installing cladding to the left, right, and top frame substrate members, thus to provide maintenance free, tough, and durable exterior surfaces to the frame.

In one set of known clad structures, a single extrusion is mounted to the substrate, providing covering on both the side surface of the substrate and over the outer surface of the substrate. Such extrusion typically provides interface structure on opposing surfaces of the substrate, whereby each extrusion is limited to the size of substrate with which such extrusion can be used.

In the alternative, a jamb plate cover is provided along a side surface of the substrate, but does not extend over the outer surface of the substrate. A separate nosing grips the jamb plate on a first surface of the substrate and grips the opposing surface of the substrate.

In an improvement in versatility of the cladding, over such structures, it is known to provide a jamb plate which has a main side panel which covers the side surface of the substrate and an outer panel which extends over the outer surface of the substrate. A nosing, such as in a brick mold profile or a window trim profile, is mounted to, and extends over, the outer panel of the jamb plate. The outer edge of the outer panel is coincident with the distal side of the nosing. The outer panel of the jamb plate is used to mount the cladding, and thus the door frame, to framing members of the building, by e.g. screws or other fasteners extending through the outer panel of the jamb plate. Accordingly, the nosing cannot be mounted on the jamb plate while the door frame is being mounted to the building.

Such configuration requires that the nosing be assembled to the jamb plate after the door frame is inserted into the rough opening and mounted to the building. By corollary, the nosing can be shipped to the construction site assembled to the jamb plates, whereupon the nosing must be disassembled from the jamb plates before the door frame can be installed on the building, and then reassembled to the door frame after the door frame has been installed. While such process provides for shipping of the nosing in an assembled configuration, disassembly at the construction site is required.

In an alternative process, the door frame is shipped to the job site without the nosing assembled to the frame. The nosing is shipped separately, though typically in the same shipment. This process saves the disassembly step at the construction site. However, the separate shipment of the nosing bears a risk of the nosing being mishandled, separated from the door frame, and lost, whereupon the installation job can be completed only by shipping an additional nosing to the job site. Another risk inherent in the above process is that a different style nosing will be shipped with the door frame, or that a different style nosing will be shipped as a replacement.

Thus, it is an object of the invention to provide a cladded door frame, including a jamb cover assembly on respective frame substrates, wherein the jamb cover assembly includes a jamb plate, a nosing, and a nailing fin, and wherein the nailing fin is so positioned with respect to the nosing that the door frame can be mounted and secured in a rough opening of a building while the jamb cover assembly is fully assembled to the respective frame substrates.

It is another objective to provide an elongate jamb plate wherein an outer panel, which overlies the outer surface of the respective jamb substrate, and which bears mounting structure for receiving a nosing thereon, is devoid of structure, outwardly of the mounting structure, for mounting the jamb plate to a framing member of a building to which the frame is to be mounted.

It is another object to provide a nosing for mounting on a jamb plate, wherein a nailing fin kerf is disposed on the nosing proximate a distal side of the nosing.

It is another object of the invention to provide, in combination, a jamb plate cooperating with a nosing wherein a mounting fin kerf is disposed in a region from proximate a distal side of the nosing to proximate a mounting structure on the jamb plate mounting the nosing and the jamb plate to each other.

Yet another object is to provide a pre-assembled door frame wherein a jamb cover assembly, comprising a jamb plate and a nosing, is mounted to one or more jamb substrates wherein a mounting fin extends outwardly beyond a distal side of the nosing thereby to enable mounting the jamb cover assembly to a framing member of a building while the nosing is mounted to the jamb plate.

Mullions can be up-graded in much the same manner of adding cladding to mullion substrates.

Accordingly, it is an object of the invention to provide a cladded mullion assembly wherein a mullion nosing is mounted to both first and second jamb plates, the jamb plates being mounted on opposing sides of the mullion substrate, and extending over the outer surface of the mullion substrate, and wherein the nosing is mounted to both of the jamb plates proximate the outer surface of the mullion substrate and thus bridges the jamb plates while covering the entire outer surface of the mullion substrate.

Still another objective is to provide a method of installing a door frame in a door opening in a building, including assembling the door frame assembly at an off-site location, transporting the door frame to the building site, and installing the frame in the building, including securing the mounting fin to building framing members while a respective nosing is installed on a respective jamb plate.

SUMMARY

The invention generally comprises aluminum cladding as jamb cover assemblies and mullion cover assemblies, for door frames and mullions, using extruded aluminum profiles as cladding over wood frame substrate members. A respective jamb cover assembly includes a jamb plate, a nosing, and a nailing fin. The nailing fin is positioned in the cover assembly such that the nailing fin extends outwardly from a distal side of the jamb cover assembly when the nosing is assembled to the jamb plate. Accordingly, the frame can be secured in a rough opening of a building with the nosing assembled to the jamb plate.

With the nailing fin extending outwardly from the fully assembled jamb cover assembly, namely with the nosing assembled to the jamb plate, the so-clad door frame can be assembled into the rough opening in the building, and secured to the building, using the nailing fin, without any assembly or disassembly of the frame or any of the cover assembly elements at the construction site.

Regarding the mullion cover assembly, first and second jamb plates are positioned on opposing sides of a mullion substrate. A mullion nosing is assembled to mounting structure at the outer panels of the jamb plates, and bridging the jamb plates so as to join together the two jamb plates and the nosing, thus to provide complete overlayment of the outer surface of the mullion substrate and to space the front panel of the nosing from the outer surface of the mullion substrate.

A first expression of the invention is embodied in an elongate jamb plate for mounting on an elongate jamb substrate of a door frame. The jamb plate comprises a main side panel for covering at least a major portion of a side surface of the jamb substrate, along at least a major portion of a length of the jamb substrate; and an outer panel for extending along at least a major portion of the length of the jamb substrate, and configured to extend at an angle transverse to the main side panel, and away from the main side panel and over an outer surface of the jamb substrate, the outer panel bearing mounting structure adapted to mount the outer panel to an elongate nosing. The outer panel is preferably devoid of structure outwardly of the mounting structure for mounting the jamb plate to a framing member of a building to which the door frame is to be mounted.

In some embodiments, the mounting structure comprises first and second spaced legs, extending outwardly from the outer panel, and including locking structure for assisting in locking the nosing to the jamb plate.

In some embodiments, the extension of the outer panel, away from the main side panel, ends proximate an outermost one of the legs.

In preferred embodiments, the jamb plate comprises an aluminum extrusion having nominal profile thicknesses of about 0.06 inch.

A second expression of the invention comprehends an elongate nosing for mounting to an elongate jamb plate, wherein the jamb plate is designed and configured to be mounted on an elongate jamb substrate of a door frame, wherein the jamb plate comprises a main side panel for covering at least a major portion of a side surface of the jamb substrate, along at least a major portion of a length of the jamb substrate, and wherein the jamb plate further comprises an outer panel for extending along at least a major portion of the length of the jamb substrate. The outer panel is configured to extend at an angle transverse to the main side panel, and away from the main side panel and over the outer surface of the jamb substrate, the outer panel bearing a first mounting structure. In such environment, the elongate nosing comprises a second mounting structure, designed and configured to cooperatively mount to the first mounting structure of the jamb plate, thereby to mount the nosing to the jamb plate. The nosing, when mounted to the jamb plate, extends away from the main side panel of the jamb plate to a distal side of the nosing, the nosing comprising a mounting fin kerf proximate the distal side of the nosing and away from the main side panel of the jamb plate.

In preferred embodiments, the nosing comprises first and second spaced legs, connected at spaced locations of the legs to a front panel of the nosing, the second mounting structure being disposed on the legs.

In preferred embodiments, a mounting fin, preferably a polymeric mounting fin, is disposed in the mounting fin kerf.

In highly preferred embodiments, the polymeric mounting fin is deflectable toward the main side panel of the jamb plate, and into proximity with a jamb substrate when the nosing is mounted to a jamb plate which is mounted to a jamb substrate.

Preferably, the nosing comprises an aluminum extrusion having nominal profile thicknesses of about 0.06 inch.

Another expression of the invention comprehends, in combination, an elongate jamb plate, and an elongate nosing for mounting to the elongate jamb plate. The elongate jamb plate comprises a main side panel for covering at least a major portion of a side surface of a jamb substrate, along at least a major portion of a length of the jamb substrate, and an outer panel extending along at least a major portion of the length of the jamb substrate, and extending at an angle transverse to the main side panel, and extending away from the main side panel and over the outer surface of the jamb substrate, the outer panel comprising a first mounting structure. The elongate nosing comprises a second mounting structure, designed and configured to cooperatively engage the first mounting structure of the jamb plate, thereby to mount the nosing and the jamb plate to each other. The nosing, when so mounted to the jamb plate, extends in a direction away from the main side panel of the jamb plate to a distal side of the nosing. The combination of the jamb plate and the nosing, when so mounted to each other, comprises a mounting fin kerf in a region from proximate the distal side of the nosing to proximate the first mounting structure.

The mounting fin kerf can be disposed on either the nosing or the outer panel of the jamb plate.

The combination preferably includes a mounting fin in the mounting fin kerf and extending outwardly beyond the distal side of the nosing and away from the main side panel of the jamb plate.

The first mounting structure preferably comprises first and second studs extending from the outer panel of the jamb plate.

The nosing preferably comprises first and second spaced legs, connected at spaced locations of the legs to a front panel of the nosing, the second mounting structure being disposed on the legs.

Preferably, the mounting structure on the nosing can snap lock to the mounting structure on the outer panel of the jamb plate, preferably to studs on the outer panel of the jamb plate.

A mounting fin is preferably mounted in the mounting fin kerf, the mounting fin preferably comprising a polymeric fin mounted in the combination of the jamb plate and the nosing at the mounting fin kerf.

The mounting fin is preferably deflectable toward the main side panel of the jamb plate, and into proximity with the jamb substrate when the elongate nosing is mounted to the jamb plate and the jamb plate is mounted to a jamb substrate.

Both the jamb plate and the nosing are preferably made from aluminum extrusions having nominal profile thicknesses of about 0.06 inch.

In some embodiments, the invention comprehends a pre-assembled door frame for assembly into a building at an opening in the building. The pre-assembled door frame comprises an elongate jamb substrate having a length, an outer surface for facing outwardly away from the building when the door frame is assembled to the building, and a side surface for facing across the opening whereat the door frame is assembled to such building; and a jamb cover assembly on the elongate jamb substrate. The jamb cover assembly comprises an elongate jamb plate comprising a main side panel covering at least a major portion of the side surface of the substrate, along at least a major portion of the length of the substrate, and an outer panel extending along at least a major portion of the length of the substrate, and extending at an angle transverse to the main side panel, and extending away from the main side panel and over the outer surface of the jamb substrate, the outer panel comprising a first mounting structure, and an elongate nosing comprising a second mounting structure, engaged with the first mounting structure on the outer panel of the jamb plate and thereby mounting the nosing and the jamb plate to each other, the nosing extending in a direction away from the main side panel to a distal side of the nosing. The jamb cover assembly comprises a mounting fin extending outwardly beyond the distal side of the nosing and in a direction away from the main side panel of the jamb plate, the mounting fin being sized and configured thereby to enable mounting the jamb cover assembly to a framing member of the building at an outwardly-facing surface of the framing member while the nosing is mounted to the jamb plate.

The invention typically comprehends a mounting fin kerf on one of the nosing and the jamb plate, optionally proximate the distal side of the nosing, the mounting fin being received in the mounting fin kerf.

The nosing optionally comprises first and second spaced legs, connected at spaced locations of the legs to a front panel of the nosing, the mounting structure of the nosing being disposed on said legs.

Preferably the mounting structure on the nosing snap locks to the mounting structure on the outer panel of the jamb plate, preferably to studs on the outer panel of the jamb plate.

In preferred embodiments, the outer panel of the jamb plate is in surface-to-surface relationship with the outer surface of the jamb substrate.

In preferred embodiments, the mounting fin is deflectable so as to be folded against the jamb substrate.

In some embodiments, the invention comprehends a cladded mullion assembly. The mullion assembly comprises a mullion substrate having a length, first and second opposing side surfaces facing in opposing directions, generally along an outer surface of a building when the cladded mullion assembly is installed on such building, and an outer surface facing outwardly from the building when the cladded mullion assembly is installed on the building; a first elongate jamb plate comprising a first main side panel extending along at least a major portion of the first side surface of the mullion substrate, along at least a major portion of the length of the mullion substrate. The first elongate jamb plate further comprises a first outer panel extending along at least a major portion of the length of the mullion substrate, and extending at an angle transverse to the first main side panel, and extending away from the first main side panel and over the outer surface of the mullion substrate, the first outer panel comprising a first mounting structure; a second elongate jamb plate comprising a second main side panel extending along at least a major portion of the second side surface of the mullion substrate, along at least a major portion of the length of the mullion substrate, the second elongate jamb plate further comprising a second outer panel extending along at least a major portion of the length of the mullion substrate, and extending at an angle transverse to the second main side panel, and extending away from the second main side panel and over the outer surface of the mullion substrate toward the first outer panel of the first jamb plate, the second outer panel comprising a second mounting structure; and an elongate nosing comprising a third mounting structure engaged with the first and second mounting structures on the first and second jamb plates and thereby mounting the nosing to the first and second jamb plates such that the nosing bridges the jamb plates, thereby locking together the combination of the nosing and the first and second jamb plates proximate the outer surface of the mullion substrate.

Typically, the nosing comprises a front panel spaced from the outer panels of the first and second jamb plates.

Preferably, the jamb plates and the nosing comprise aluminum extrusions, preferably aluminum extrusions having nominal profile thicknesses of about 0.06 inch.

Preferably, the first and second outer panels of the respective first and second jamb plates are in surface-to-surface relationship with the outer surface of the mullion substrate.

The invention also comprehends a method of installing a door frame in a door opening in a building. The method comprises, at an off-site location, assembling the door frame, comprising assembling together left, right, and top frame substrate members, each having a side surface facing inwardly of the opening in the building when installed in the building and an outer surface facing outwardly away from the building when installed in the building, thereby to make a door frame precursor having left, right, and top frame elements; installing, on the substrate members, elongate jamb plates wherein each jamb plate comprises a main side panel covering at least a major portion of the side surface of the respective substrate member, and an outer panel extending along a major portion of the outer surface of the respective substrate member; mounting nosings on the outer panels of the jamb plates; and at at least one of the left, right, and top frame elements, assembling a mounting fin to one of the respective jamb plate and the respective nosing, the mounting fin extending outwardly away from the main side surface and away from both the nosing and the jamb plate.

The method further comprises transporting the so-assembled door frame to the building site; and installing the so-assembled door frame to the building, including securing the mounting fin to a building frame member while the respective nosing is installed on the respective frame plate.

In preferred embodiments, the method includes assembling a mounting fin to each of the left, right, and top frame elements such that the respective mounting fins extend outwardly, away from the main side panels of the jamb plates and generally in directions consistent with the outer panels of the jamb plates when the door frame is assembled to the building.

Figure 1:
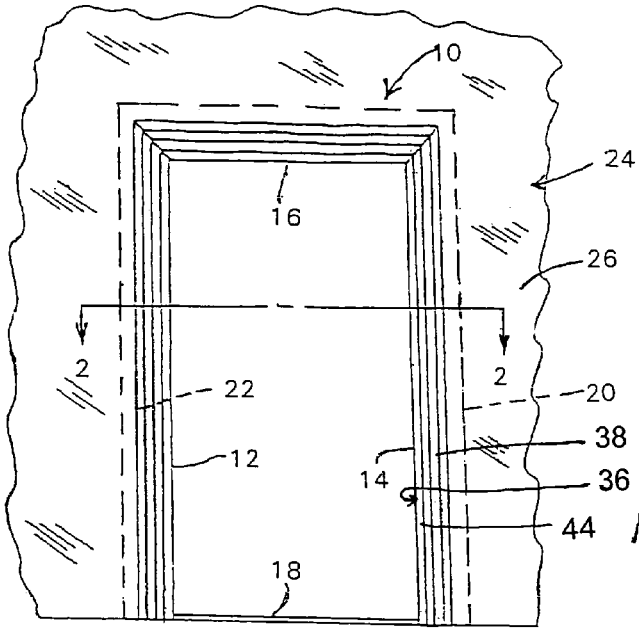
FIG. 1 shows a front elevation view of a door frame of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 2:
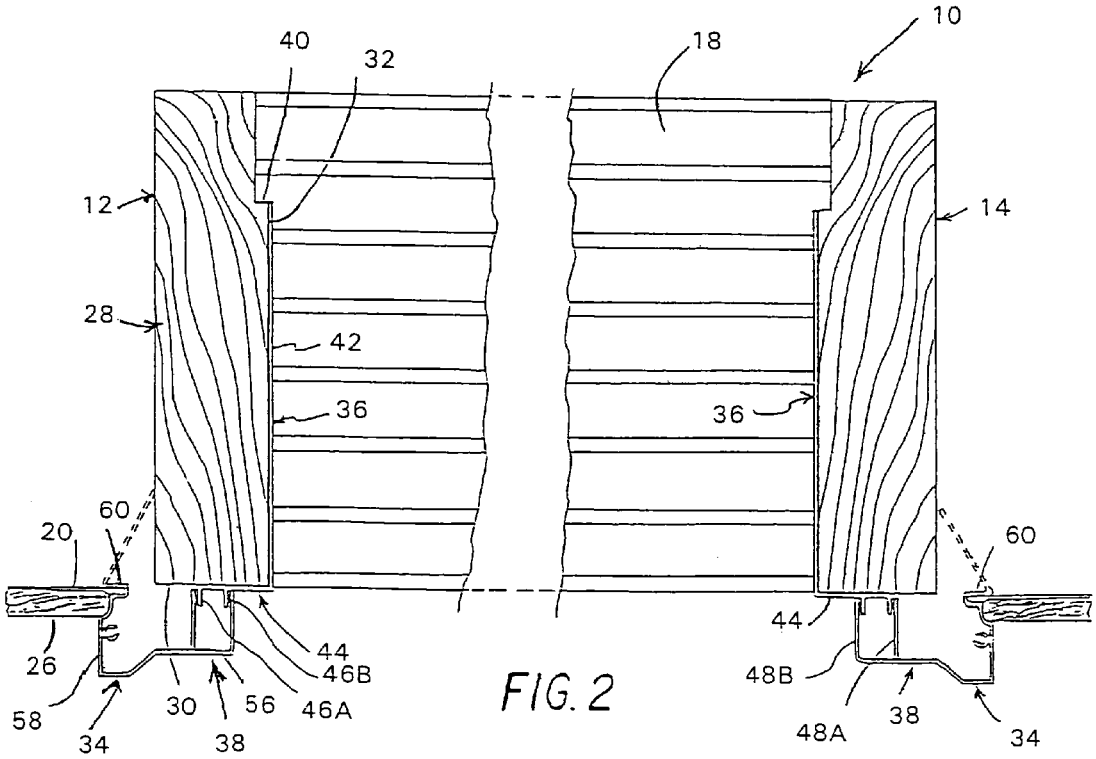
FIG. 2 shows an enlarged cross-section of the door frame of FIG. 1, taken at 2-2 of FIG. 1.

Referring now to the drawings, FIGS. 1 and 2 show a pre-assembled door frame 10 of the invention, The door frame includes a left frame element 12, a right frame element 14, a top frame element 16, and a sill 18, as well as a nailing fin 20 mounted to each of the left, right, and top frame elements. The door frame as shown in FIG. 1 has been inserted into a rough opening 22 in a building 24. As illustrated in FIGS. 1 and 2, a layer of sheet material 26 such as sheathing or siding has been installed over the nailing fin.

Figure 3:
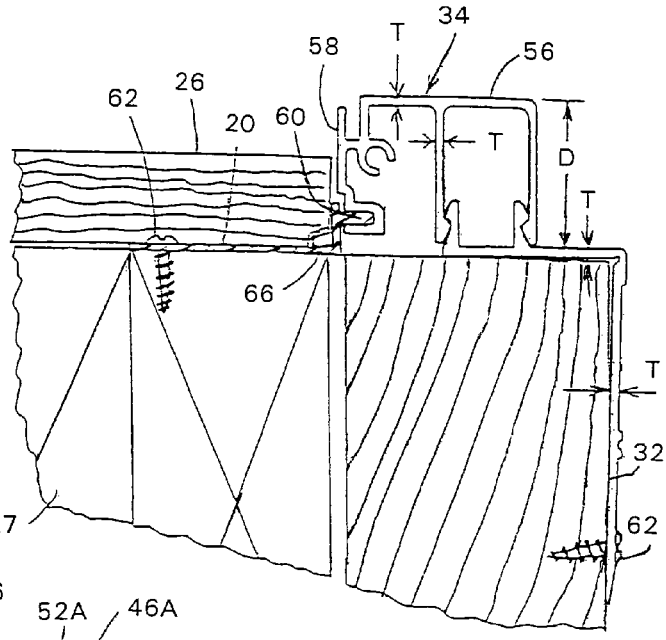
FIG. 3 shows a fragmentary cross-section of a jamb cover assembly of the invention having a medium-width nosing, and mounted on a door jamb.
Figure 4:
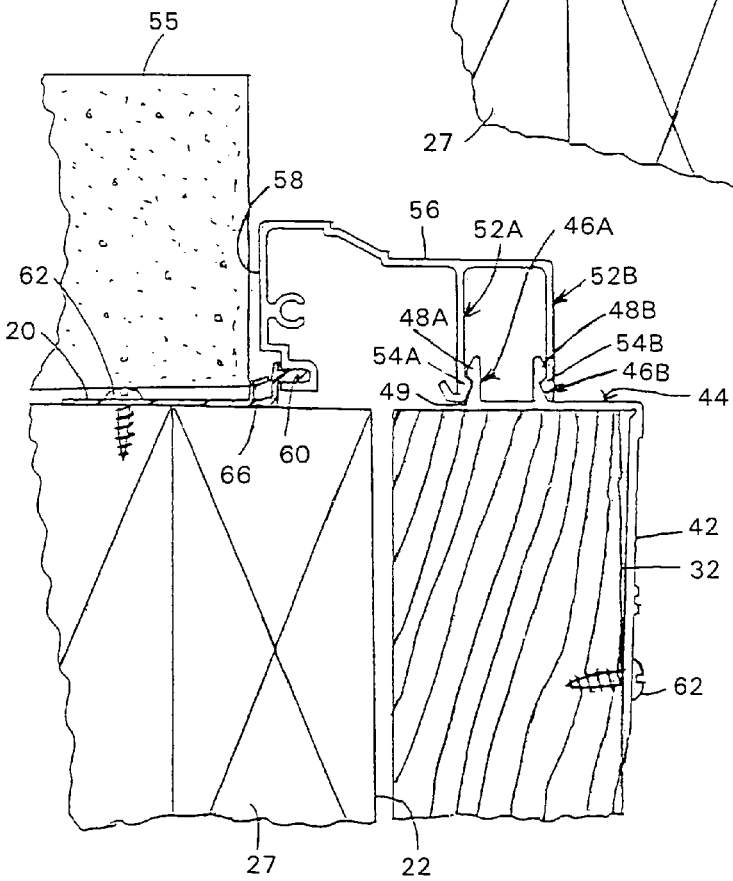
FIG. 4 shows a fragmentary cross-section of a jamb cover assembly of the invention having a brick-mold nosing, and mounted on a door jamb.

Referring to FIG. 2, the left, right, and top frame elements all have substantially the same structure, so only one will be described. Framing members 27 of the building are not shown in FIG. 2 in order to focus attention on the jamb cover assemblies of the invention. Those skilled in the art will know the typical dimensions of the door framing members, and the typical locations and standard dimensions of the building framing members, which are shown in FIGS. 3 and 4. Referring to the left frame element in FIG. 2, an elongate wood jamb substrate element 28 extends the full length of the left frame element and serves as a substrate for the left frame element. Substrate 28 has a length, of typical standard dimension an outer surface 30 providing a building interface, facing outwardly away from the building and a side surface 32 facing across opening 22 in the building.

A jamb cover assembly 34 is mounted to the elongate wood substrate. The jamb cover assembly includes an elongate jamb plate 36, a nosing 38, and a respective nailing fin 20. Jamb plate 36 includes a main side panel 42 covering at least a major portion of the side surface 32 of the substrate, along at least a major portion of the length of the substrate. In preferred embodiments, as in FIGS. 1 and 2, the main side panel covers substantially the entirety of the substrate side surface from the outer surface 30 of the substrate to the door seat 40.

Jamb plate 36 further includes an outer panel 44 covering at least a substantial portion, optionally a major portion, of the outer surface 30 of the substrate, along at least a major portion of the length of the substrate. In preferred embodiments, as in FIGS. 1 and 2, the outer panel extends along substantially the entire length of the substrate outer surface. As seen in FIG. 2, the outer surface of the jamb plate is attached to main side panel 42 and extends at a perpendicular, or nearly perpendicular, angle transverse to the main side panel, and extends away from the main side panel and over the outer surface of the jamb substrate. In the embodiment illustrated, the outer panel of the jamb plate is in general surface-to-surface relationship, optionally surface-to-surface contact, with the outer surface of the substrate.

Referring more particularly to FIGS. 3 and 4, the outer panel further includes first mounting structure in the form of first and second studs 46A and 46B which have snap locks 48A and 48B, as locking loci, proximate the ends of the respective studs. As illustrated in FIGS. 3 and 4, cross sections of studs 46A and 46B can be substantial mirror images of each other. Outer panel 44 extends to a distal edge 49 proximate the outermost leg 46A.

Nosing 38 is shown in FIG. 2 as a cross-sectional outline commonly recognized as a "brick mold" in the building trades. Nosing 38 includes second mounting structure in the form of first and second legs 52A and 52B which have snap locks 54A, 54B on the respective legs, cooperating with snap locks 48A and 48B to mount the nosing 38 to outer panel 44 of jamb plate 36.

Legs 52A and 52B extend outwardly from studs 46A and 46B and away from the building and are connected at spaced locations of the legs to a front panel 56 of the nosing. Front panel 56 extends transversely of the jamb plate main panel, and follows a direction generally corresponding to the direction of extension of outer panel 44 of the jamb plate. Front panel 56 is typically displaced from the outer surface of the substrate, and thus from the outer panel of the jamb plate, by a distance corresponding to a typical thickness of brick mold or the like. Accordingly, while spacing between the outer surface of the substrate and the front panel of the jamb plate can, in some instances, be a nominal distance, the typical application of the nosing is directed toward replacing the typical e.g. brick mold type or like trim around a door frame. Thus, typical distances between the outer surface of the substrate and the outer surface of the front panel are about 0.5 inch to about 1.5 inches, preferably about 0.6 inch to about 1.25 inches, even more preferably about 1 inch to about 1.13 inches.

Nosing 38 typically extends alone a substantial portion of the length of jamb plate 36. As illustrated in FIGS. 1-4 nosing 38 can extend along the entirety of the length of jamb plate 36, in a relationship overlying a portion of the width of outer panel 44.

Front panel 56 of the nosing can and typically does deviate to an extent from a true reproduction of the direction of extension of the front panel of the jamb plate, and thus can define a non-planar surface profile, or an interrupted planar surface profile, or a partially planar surface profile, of the nosing which nonetheless extends generally along, and displaced from, the outer surface of the outer panel of the jamb plate. FIG. 3 shows a profile generally corresponding with commonly known window trim profiles. FIG. 4 shows the profile generally known as a brick mold profile, and shows a brick 55 representatively shown located adjacent the brick mold.

As seen in FIGS. 2-4, front panel 56 extends away from legs 52A and 52B, away from main side panel 42 of the jamb plate, to a distal side 58 of the nosing. A nailing fin kerf 60 is built into either the jamb plate or the nosing. In general, the nailing fin kerf can be located in a region which extends from proximate the distal side of the nosing to proximate studs 46A and 46B of the outer panel of the jamb plate. In FIGS. 2-4, the nailing fin kerf is located at distal side 58 of the nosing, nailing fin 20 being mounted in kerf 60. In the embodiments illustrated in FIGS. 2-4, nailing fin kerf 60 is located at the distal side of the nosing, whereby nailing fin 20 extends outwardly from the distal side of the combination of the nosing and the jamb plate. In the embodiments shown, the nailing fin kerf is built into the distal side of the nosing. The nailing fin kerf can be located inwardly of the distal side of the nosing, more toward leg 52A. Typically, the outer panel of the jamb plate, and thus the entire jamb plate, is devoid of any nailing fin kerf. However, in some less preferred embodiments, the nailing fin kerf can be an element of the outer panel of the jamb plate, generally proximate outer stud 46A. Wherever the nailing fin kerf, the nailing fin, itself, must extend outwardly of the side edge of the nosing so that the nailing fin can be secured to framing members of the building, thereby securing the assembly to the building while the nosing is assembled to the outer panel of the jamb plate.

A wide variety of mounting structures are contemplated for joining jamb plate 36 and nosing 38 to each other, as a two-component jamb cover assembly, with optional addition of the mounting fin to the two-component jamb cover assembly, whereby locks 48A, 48B, 54A, 54B are merely exemplary of such mounting structures.

While two nosing structures are illustrated in FIGS. 2-4, the nosings illustrated are merely exemplary of a wide variety of nosing structures which can be employed in the invention.

As illustrated in FIGS. 3 and 4, the jamb cover assembly 34 is secured to the jamb substrate e.g. at side surface 32 by screws, nails, or like fasteners 62. The jamb cover assembly can also be secured to the jamb substrate at other locations such as at outer surface 30 of the jamb substrate (securement not shown). The nosing is mounted to the jamb plate by the mounting structures represented by locks 48A, 48B, 54A, 54B. Nosing 38 is in turn secured to a building frame member 27 by screws, nails or like fasteners 62 through nailing fin 20.

By providing the jamb plate, the nosing, and the nailing fin as separate jamb cover elements, a wide variety of framing needs can be satisfied with a limited inventory of such cover elements.

Whereas prior art jamb cover assemblies require securing the nailing fin to the building framing member under the nosing, which requires that the nosing be assembled to the jamb plate after field installation of the frame in the rough opening at the building site; by positioning the nailing fin such that the nailing fin extends outwardly from the distal side of the jamb cover assembly in the invention, the jamb cover assembly members, including the nosing, can all be mounted, directly or indirectly, to the frame substrate elements of the door frame assembly, in an off site manufacturing facility, whereby no frame assembly need be accomplished at the building site.

Accordingly, the door frame can be shipped to the building site fully assembled. The nosing need not be shipped separately, thereby obviating any risk of losing the nosing in transit, or forgetting to put the nosing on the truck with the door frame. Similarly, the nosing need not be assembled to the frame at the building site.

Jamb plate 36 and nosing 38 are preferably metal extrusions, such as aluminum extrusions wherein the respective profile elements of the extrusions have profile thicknesses "T" of about 0.04 inch to about 0.07 inch, with preferred thicknesses of about 0.06 inch. A highly preferred thickness is about 0.062 inch.

As illustrated in FIGS. 2-4, the nailing fin includes a hinge 66 which facilitates articulating or deflecting the nailing fin downwardly toward substrate element 28 as illustrated in dashed outline in FIG. 2 for shipping the door frame, and erecting the nailing fin as illustrated in solid outline in FIG. 2 for attaching the door frame to a building.

Figure 5:
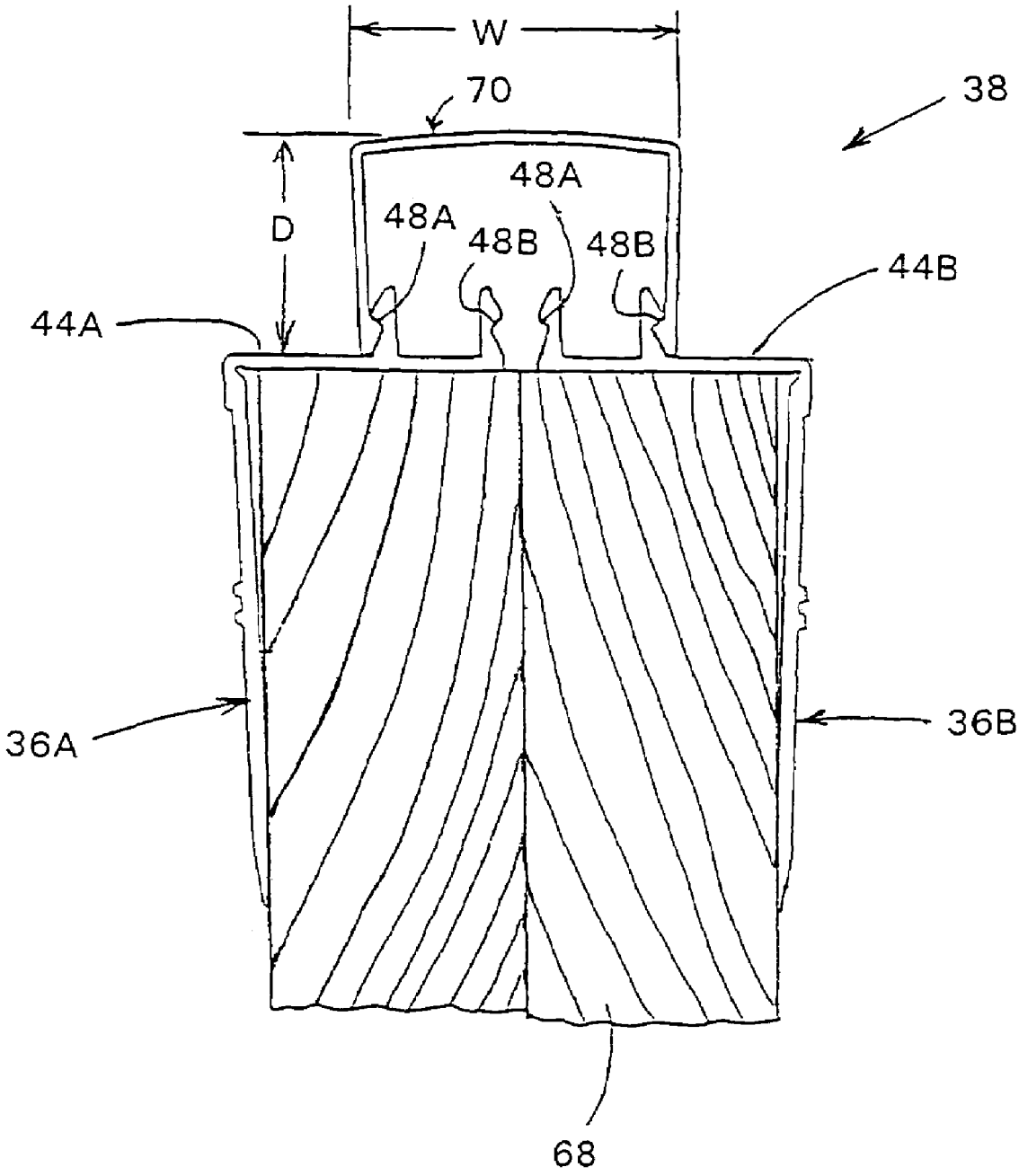
FIG. 5 shows a mullion covered on opposing side surface by first and second jamb plates of the invention, and a special mullion nosing cover of the invention mounted to the jamb plates and bridging the jamb plates, thereby to provide a unitary appearance to the face of the mullion while protecting the mullion from the outside environment.

FIG. 5 shows the principles of the jamb cover assembly, including first and second jamb plates 36 and a nosing 38, applied to a mullion substrate 68 adjacent a door opening, as a mullion cover assembly. Such mullion cover assembly can be used, for example, with the combination of a door frame and a side light, or between glass panes in a window or window cluster. As shown in FIG. 5, first and second jamb plates 36A, 36B as used in the previous embodiments as part of a door frame are positioned on opposing side surfaces of the mullion substrate. The main side surfaces of the jamb plates cover respective side surfaces of the mullion substrate.

Outer panels 44A, 44B of the respective jamb plates partially cover the outer surface of the mullion substrate 68, optionally leaving a portion of the mullion substrate uncovered as shown in FIG. 5. A special mullion nosing 70 bridges the jamb plates, and snap locks to a respective snap lock structure 48A, 48B on each of the jamb plates, thereby locking together the combination of the mullion nosing and the two jamb plates.

The mullion nosing extends outwardly from the outer panels and locking studs of the jamb plates, preferably a distance "D" consistent with the distance "D" on the nosings of corresponding door jamb cover assemblies, such that the distance "D" of extension of the nosing from the jamb plates, at the mullion cover, is the same distance "D" of extension of the nosings from the jamb plates at the door frames, whereby the nosings will present a common depth appearance about the entirety of the door area.

Mullion nosing 70 is merely a further illustration of the wide variety of nosing structures which can be attached to jamb plates 36. The width "W" of the mullion nosing can be selected according to the width of the mullion substrate to which the mullion cover assembly is to be assembled, in combination with the dimensions of the jamb plates with which the mullion nosing is to be used. The width "W", of any of the nosings 38 used with jamb cover assemblies 34, can be selected based on a variety of considerations including, without limitation, aesthetic appeal, and availability of a building framing member to receive nailing fin 20 beyond the distal side of the nosing.

The jamb and mullion cover assemblies of this invention are well suited to provide protective covering for e.g. wood, plastic, or other substrates useful in fabricating door frames, mullions, and the like. Thus, in typical application, the frame or mullion is fabricated by a frame or mullion fabricator, and shipped to a door assembler. The door assembler receives the frame as fabricated, and assembles the frames to door slabs, which are also commonly purchased separately. The door assembler adds the desired glass inset, if any, to the door slab, as needed, and assembles the door slab to a selected door frame. Typically, the basic frame is wood.

The door assembler can easily up-grade the quality and value of the door and frame by installing jamb cover assemblies of the invention to the left, right, and top frame substrate members, thus to provide a maintenance free, tough, and durable exterior surface to the frame. Mullions can be up-graded in the same manner. The thus up-graded frame and/or mullion is shipped to the builder at the building site. The builder installs the frame, with or without the door slab, in the respective rough opening in the building. If the door slab is not installed with the frame, the door slab can be installed at another time.

By designing and configuring the jamb cover assemblies of the invention with the nailing fin extending outwardly from the nosing, the on-site installation to the building can be done without removing the nosing from the jamb cover assembly. By corollary, the jamb cover assembly can be installed without the need to install the nosing to the jamb plate at the building site. Since all such assembly can be accomplished at the off-site manufacturing facility, relatively tighter tolerances can be used, assembly errors can be better controlled, and assembly damage can be better controlled or reduced, as compared to on-site assembly operations. Thus, where cover assemblies of the invention are used in constructing new buildings, the invention provides improved quality control to the process of installing door frames and mullions in the buildings.

Overall, the cover assemblies of the invention produce frames which are known as "cladded" products. Namely, typical frame materials are "cladded" with the cover assemblies of the invention in order to up-grade the value of the resulting product.

In an alternative use of jamb cover assemblies and mullion cover assemblies of the invention, the cover assemblies are installed to the jamb substrates or the mullion substrates at the building site. Such on-site installation can be used e.g. where no local door assembler provides the cladding service. In addition, such on-site installation of the cladding elements can be used to up-grade an existing building, or an existing door frame and/or mullion in an existing building. In such case, the cladding elements, namely the jamb plates and nosings, are installed on the jamb and/or mullion at the building site as add-on components of the respective frame or mullion. In the instance of the existing building, use of the nailing fin is obviated.

It should be noted that, while the above embodiments, such as at FIG. 1, have suggested use of the invention with personnel doors, the invention can be used with doors of practically any size. Thus, the inventor contemplates use of the invention on, for example and without limitation, garage doors, doors at truck shipping docks, and double personnel doors.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A jamb cover combination, comprising an elongate jamb plate, and, as a separate element, an elongate nosing, (a) said jamb plate (i) having a length, and comprising a main side panel, and (ii) comprising an outer panel extending, from a locus of joinder with said main side panel, at an angle transverse to said main side panel, to a distal end of said outer panel, (b) said elongate nosing having a proximal side and a distal side (58), and a remote front panel (56), said nosing extending from the proximal side to the distal side as a single-piece unitary structure, said nosing and said jamb plate collectively comprising mounting assembly structure whereby said jamb plate and said nosing can be assembled to each other, said nosing, when so assembled to said jamb plate, being displaced from said main side panel and extending beyond the distal end of said outer panel, such that the distal end of the outer panel is disposed between said main side panel and the distal side of said nosing, further comprising a mounting fin kerf in said nosing.

2. A jamb cover combination as in claim 1, said jamb cover combination being configured such that said main side panel can overlie a first side of a substrate being covered by said jamb cover combination and said outer panel can overlie a second side of such substrate being covered by said jamb cover combination.

3. A jamb cover combination as in claim 1, said mounting fin kerf being defined in said nosing remote from said front panel of said nosing.

4. A combination as in claim 3, said nosing and said jamb plate being assembled to each other, further comprising a mounting fin, as a separate and distinct element, in said mounting fin kerf, said mounting fin extending beyond the distal side of said nosing.

5. A jamb cover assembly combination comprising an elongate jamb plate extrusion member and an elongate nosing extrusion member, (i) said jamb plate extrusion member, when finished to a first length, and (ii) said elongate nosing extrusion member, when finished to a second length which cooperates with the first length, being collectively adapted and configured to be assembled into a jamb cover assembly, said jamb plate member comprising (a) a main side panel, (b) an outer panel extending at an angle transverse to said main side panel, to a distal end of said outer panel, and (c) no additional panel opposing said main side panel, said elongate nosing member being designed and configured to extend along a substantial portion of such first length of said jamb plate member, said elongate nosing member having a proximal side and a remote front panel (56) and extending, as a single-piece unitary structure, from the proximal side to a distal side (58) of said nosing member, said jamb plate member and said nosing member collectively comprising assembly structure whereby said jamb plate member and said nosing member are adapted and configured to be assembled to each other through such assembly structure which communicates with said outer panel of said jamb plate member, said nosing member, when so assembled to said jamb plate member being displaced from said main side panel and extending beyond the distal end of said outer panel, such that the distal end of the outer panel is disposed between said main side panel and the distal side of said nosing.

6. A jamb cover assembly combination as in claim 5 wherein said nosing member comprises a brick mold nosing member which is defined, along the second length, by a generally constant cross-section.

7. A jamb cover assembly as in claim 5 wherein said nosing member and said jamb plate member comprise aluminum extrusions.

8. A door frame having a left frame element, a right frame element, and a top frame element, said left frame element, said right frame element, and said top frame element being assembled from a jamb cover assembly combination as in claim 5.

9. A jamb cover assembly combination as in claim 5, said jamb cover assembly combination being configured such that said main side panel can overlie a first side of a substrate being covered by said jamb cover assembly combination and said outer panel can overlie a second side of such substrate being covered by said jamb cover assembly combination.

10. A jamb cover assembly combination as in claim 5, further comprising, a mounting fin kerf in said nosing member.

11. In combination, an elongate jamb member and an elongate nosing member, (i) said jamb member, when finished to a first length, and (ii) said elongate nosing member, when finished to a second length which cooperates with the first length, being collectively adapted and configured to be assembled to each other to define a jamb assembly, such jamb assembly being adapted and configured to define at least a portion of a door frame, such door frame at least in part defining a doorway opening, said jamb member having a length, and comprising (a) a first main side, and (b) a second outer side extending at an angle transverse to said first main side, to a distal end of said second outer side, said elongate nosing member being designed and configured to extend along a substantial portion of such first length of said jamb member, said jamb member and said nosing member collectively comprising assembly structure whereby said jamb member and said nosing member are adapted and configured to be assembled to each other through such assembly structure which communicates with said second outer side of said jamb member, such that said nosing member overlies at least a portion of said second outer side and does not overlie said first main side, said elongate nosing member having a proximal side, and extending as a single unitary structure from the proximal side to a distal side (58) of said elongate nosing member, and wherein, when said elongate jamb member and said elongate nosing member are assembled to each other and at least in part define a portion of such door frame, the distal side of said nosing is disposed beyond the distal end of said second outer side of said jamb member, such that the distal end of said second outer side is disposed between the distal side of said elongate nosing member and said first main side of said elongate jamb member, further comprising a mounting fin kerf in said nosing.

12. A combination as in claim 11 wherein said nosing member and said jamb member comprise aluminum extrusions.

13. A door frame, comprising a left frame element, a right frame element, and a top frame element, each comprising a door frame structure as in claim 11.

14. A combination as in claim 11 wherein said elongate jamb member comprises a first elongate extrusion member and wherein said elongate nosing member comprises a second elongate extrusion member.

15. A combination as in claim 14 wherein said elongate jamb member and said elongate nosing member are finished to cooperating first and second lengths so as to be assembled to each other to make a jamb cover assembly.

16. A door frame comprising a left frame element, a right frame element, and a top frame element, said left frame element, said right frame element, and said top frame element being assembled from combinations as in claim 15.

17. A door frame structure, adapted and configured to define at least a portion of such door frame, said door frame structure having been assembled using a combination of a jamb member and a nosing member, each of claim 15, assembled to each other, and wherein said jamb member comprises a main side panel on said first main side and an outer panel on said second outer side, and wherein said nosing member overlies at least a portion of said outer panel and does not overlie said main side panel.

18. A combination as in claim 11, said jamb cover assembly combination being configured such that said main side panel can overlie a first side of a substrate being covered by said jamb cover assembly combination and said outer panel can overlie a second side of such substrate being covered by said jamb cover assembly combination.

19. A door frame assembly combination, adapted and configured to be assembled into a door frame assembly which defines a doorway opening extending through such door frame assembly, such door frame assembly being adapted and configured to be assembled to a building, said door frame assembly combination comprising an elongate first frame member and an elongate nosing member, said first frame member having (a) a first side adapted and configured to face across such doorway opening, and (b) a second side adapted and configured to face away from such doorway opening and to face away from such building, and extending at an angle transverse to said first side, to a distal end of said second side, said elongate nosing member, when said first frame member is finished to a first length and said nosing member is finished to a cooperating second length, and said first frame member and said nosing member are assembled to each other, being adapted to extend along a substantial portion of the first length of said first frame member, said elongate nosing member having a proximal side and a remote front panel (56) and extending, as a single-piece unitary structure, from the proximal side to a distal side (58) of said nosing member, said first frame member and said nosing member collectively comprising assembly structure whereby said first frame member and said nosing member are adapted and configured to be assembled to each other through said assembly structure which communicates with said second side of said first frame member, thereby to assemble a frame assembly, a plurality of such frame assemblies being adapted and configured to be assembled into a such door frame, further comprising, a mounting fin kerf in said nosing member, remote from said front panel, said mounting fin kerf, when said first frame member and said nosing member are assembled to each other, being located outwardly of the distal end of said second side, such that the distal end of said second side is disposed generally between said mounting fin kerf and said first side.

20. A frame assembly as in claim 19 wherein said first frame member and said nosing comprise aluminum extrusions.

21. A frame assembly as in claim 19 wherein said first frame member and said nosing member comprise aluminum extrusions.

22. A frame assembly combination as in claim 19, said first frame member further comprising a third side, which third side faces away from such doorway and in a direction generally opposite the first side, said mounting fin kerf defining an opening, the opening being configured to receive a mounting fin thereinto, further comprising a mounting fin in said mounting fin kerf, said first frame member extending along a generally continuous path between the third side and the first side.

23. A frame assembly as in claim 19 wherein said first frame member and said nosing comprise aluminum extrusions.

24. A door frame assembly combination as in claim 19, said elongate first frame member being finished to fit a first size doorway, said elongate nosing member being finished to fit such first size doorway, said frame member and said nosing member being assembled to each other such that said nosing member extends along a substantial portion of the first length of said first frame member.

25. A door frame assembly made with a door frame assembly combination of claim 19, said door frame assembly defining at least a portion of a door frame which defines a doorway opening therethrough, such door frame being adapted and configured to be assembled to a building at an opening in such building, said elongate first frame member having a first length and said elongate nosing having a second length, generally cooperating with the first length, said nosing being joined to said first frame member, said first frame member further comprising a third side facing away from the doorway opening and in an opposite direction from the first side, and a fourth side facing in an opposite direction from the second side, said first frame member and said nosing being joined to each other at only one of the second and fourth sides of said first frame member.

26. A frame assembly as in claim 25, further comprising a mounting fin mounted in said mounting fin kerf, said first frame member consisting of a generally continuous unitary structure extending from the third side to the first side.

27. A door frame assembly comprising an elongate jamb having a first length and an elongate nosing having a second length, and joined to said jamb, said jamb having (a) a main side panel, and (b) an outer panel extending at an angle transverse to said main side panel, to a distal end of said outer panel, said elongate nosing having a proximal side and extending, as a single unitary structure, from the proximal side to a distal side (58) of said elongate nosing, said elongate nosing being displaced from said main side panel of said jamb, said nosing extending beyond the distal end of said outer panel of said jamb such that the distal end of the outer panel is disposed between said main side panel and the distal side of said nosing, further comprising a mounting fin kerf in said nosing, located outwardly of the distal end of said outer panel, such that the distal end of said outer panel is disposed generally between said mounting fin kerf and said main side panel, said mounting fin kerf defining an opening, configured to receive a mounting fin thereinto.

28. A door frame assembly as in claim 27, further comprising a mounting fin in said mounting fin kerf, and wherein said nosing comprises a brick mold nosing which is defined, along the second length, by a generally constant cross-section.

29. A door frame assembly as in claim 27 wherein said jamb and said nosing comprise aluminum extrusions.

30. A door frame assembly having a left frame element, a right frame element, and a top frame element, each of said left frame element, said right frame element, and said top frame element comprising a jamb and a nosing as in claim 27.

31. A jamb cover assembly combination comprising an elongate jamb plate finished to fit a first door size, and an elongate nosing finished to fit such first door size, said jamb plate and said nosing being collectively adapted and configured to be assembled into a jamb cover assembly which fits such first door size, said jamb plate comprising a 2-panel jamb plate having (a) a main side panel, and (b) an outer panel extending at an angle transverse to said main side panel, to a distal end of said outer panel, said elongate nosing having a proximal side and a remote front panel (56), and being designed and configured to extend along a substantial portion of such first length of said jamb plate and consisting of a single unitary structure, said jamb plate and said nosing collectively comprising assembly structure thereby to mount said jamb plate and said nosing to each other through said assembly structure, at least a portion of said assembly structure communicating with said outer panel of said jamb plate, said nosing being displaced from said main side panel, further comprising, a mounting fin kerf in said nosing, said mounting fin kerf, when said nosing is assembled to said jamb plate at said outer panel, being located outwardly of the distal end of said outer panel, such that the distal end of said outer panel is disposed generally between said mounting fin kerf and said main side panel.

32. A jamb cover assembly combination as in claim 31, said mounting fin kerf being disposed at a distal side of said nosing, said jamb cover assembly combination further comprising a mounting fin, said mounting fin being designed and configured to be mounted in said mounting fin kerf.

33. A jamb cover assembly combination as in claim 31, said nosing having a proximal side and extending, as a single-piece structure, from the proximal side to a distal side (58) of said nosing, and wherein said nosing comprises a brick mold nosing which is defined, along the second length, by a generally constant cross-section.

34. A door frame having a left frame element, a right frame element, and a top frame element, each of said left frame element, said right frame element, and said top frame element being assembled from a jamb cover assembly combination as in claim 31.

35. A jamb cover assembly combination as in claim 31 wherein said jamb plate and said nosing comprise aluminum extrusions.

36. A door frame assembly combination which, when assembled into a door frame assembly, defines at least a portion of a door frame which defines a doorway opening therethrough, such door frame being adapted and configured to be assembled to a building at an opening in such building, said door frame assembly combination comprising an elongate jamb substrate having a first length, an elongate jamb plate having a second length generally corresponding to the first length and an elongate nosing having a third length generally corresponding to the second length, said elongate nosing being assembled to said jamb plate, said jamb plate and said jamb substrate defining a frame element subassembly, said frame element subassembly having (a) a first side defined at least in part by said jamb plate and facing across the doorway opening, (b) a second side defined at least in part by said jamb plate and facing away from the doorway opening and away from the building, (c) a third side facing in an opposite direction from the first side, and (d) a fourth side facing in an opposite direction from the second side, said elongate nosing having a proximal side and a remote front panel (56), and extending as a single unitary structure from the proximal side to a distal side of said elongate nosing member, said frame element subassembly and said nosing being assembled to each other through assembly structure which communicates with only one of the second and fourth sides of said frame element, further comprising a mounting fin kerf in said nosing, displaced from said front panel and located outwardly of the third side of said frame element subassembly, such that the third side of said frame element subassembly is disposed generally between said mounting fin kerf and the first side of said frame element subassembly.

37. A frame assembly as in claim 36 wherein said frame element and said nosing comprise aluminum extrusions.

* * * * *